United States Patent [19]

Bocker et al.

[11] Patent Number: 4,692,885

[45] Date of Patent: Sep. 8, 1987

[54] OPTICAL FLOATING-POINT MATRIX-VECTOR MULTIPLIER

[75] Inventors: Richard P. Bocker, San Diego; William J. Miceli, La Jolla, both of Calif.

[73] Assignee: United States of America as represented by the Secretary of the Navy, Washington, D.C.

[21] Appl. No.: 813,738

[22] Filed: Dec. 27, 1985

[51] Int. Cl.[4] ..... G06J 1/00; G06G 9/00

[52] U.S. Cl. ..... 364/606; 364/845

[58] Field of Search ..... 369/606, 841, 845, 822, 369/861, 713, 837

[56] References Cited

U.S. PATENT DOCUMENTS

| | | | |
|---|---|---|---|
| 3,588,486 | 6/1971 | Rosen | 364/861 |
| 3,809,873 | 5/1974 | Klahr | 235/181 |
| 3,937,942 | 2/1976 | Bromley et al. | 364/822 |
| 4,009,380 | 2/1977 | Bocker et al. | 364/713 X |
| 4,297,704 | 10/1981 | Marom et al. | 364/713 |
| 4,592,004 | 5/1986 | Bocker et al. | 364/713 |
| 4,603,398 | 7/1986 | Bocker et al. | 364/606 X |
| 4,633,427 | 12/1986 | Bocker | 364/872 |

*Primary Examiner*—Jerry Smith
*Assistant Examiner*—Charles B. Meyer
*Attorney, Agent, or Firm*—Robert F. Beers; Ervin F. Johnston; Thomas Glenn Keough

[57] ABSTRACT

A digital multiplication by analog convolusion algorithm is extended by a hybrid combination of both floating and fixed-point arithmetic. An acousto-optical time-integrating architecture uses a binary representation of the hybrid combination of floating and fixed-point arithmetic. An array of full adders in conjunction with a photodetector array avoids generating mixed binary outputs that normally result when the digital multiplication by analog convolution algorithm is applied so as to eliminate the need for analog-to-digital converters otherwise needed to convert mixed binary to pure binary.

15 Claims, 6 Drawing Figures

| $d_i$ | $m_i$ | $q_i$ | $r_i$ | $q_{i+1}$ |
|---|---|---|---|---|
| 0 | 0 | 0 | 0 | 0 |
| 0 | 0 | 1 | 1 | 0 |
| 0 | 1 | 0 | 1 | 0 |
| 1 | 0 | 0 | 1 | 0 |
| 0 | 1 | 1 | 0 | 1 |
| 1 | 0 | 1 | 0 | 1 |
| 1 | 1 | 0 | 0 | 1 |
| 1 | 1 | 1 | 1 | 1 |

Full-adder Truth Table

OPTICAL FLOATING-POINT MATRIX-VECTOR MULTIPLIER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Modern day signal, image, and information processing increasingly relies on the use of matrix algebra as one of its basic computational tools. In addition, many of today's problems require a real-time computational capability as well. As a consequence, current emphasis is placed on the development of dedicated electronic parallel processing devices using VLSI/VHSIC technology to perform the intensive computations required in numerical matrix algebra. Based on the proliferation of journal articles in this field over the past five years, a growing interest in the use of optical processing techniques to perform matrix operations is materializing. Optics, with its innate parallelism, noninterfering communication and high bandwidth, has successfully demonstrated its strengths in the past two decades to perform convolutions and correlations, as well as a variety of linear transform operations. However, to assure that optical processing has a significant impact on general matrix computation, new concepts and devices are being formulated and conceived which improve the precision of computations performed optically.

One technique which has demonstrated improved optically performed precision of computations employs an algorithm to perform fixed-point multiplications and additions and uses optical convolving devices as set out by H. J. Whitehouse and J. M. Speiser in their article entitled "Linear Signal Processing Architectures" *Aspects of Signal Processing with Emphasis on Underwater Acoustics,* G. Tacconi, Ed. (Reidel, Dordrecht, 1977), Part II and by D. Psaltis, D. Casasent, D. Neft and M. Carlotto in their article entitled "Accurate Numerical Computation by Optical Convolution," SPIE, Vol. 232, pp. 151–156, 1980. The algorithm of these two articles has gained popularity as the digital multiplication by analog convolution (DMAC) algorithm. For the case of radix 2, for example, the DMAC algorithm is novel in that binary numbers may be added without carries if the output is allowed to be represented in a mixed binary format. In the mixed binary format, like binary arithmetic, each digit is weighted by a power of 2, but unlike binary arithmetic, the value of each digit can be greater than 2. Eliminating the need for carries makes this technique particularly attractive in terms of optical implementation. The DMAC algorithm has been used in optical architectures to perform matrix multiplication involving numbers expressed in fixed-point form. Examples of such use are set out in numerous articles such as the presentation of W. C. Collins, R. A. Athale, and P. D. Stilwell in "Improved Accuracy for an Optical Iterative Processor", *SPIE* Vol. 352, pp. 59–66, 1982 in the article by R. P. Bocker, S. R. Clayton and K. Bromley in "Electro Optical Matrix Multiplication Using the Twos Complement Arithmetic for Improved Accuracy" *Applied Optics,* Vol. 22, pp. 2019–2021, 1983, in the article by P. S. Guilfoyle in "Systolic Acousto-Optic Binary Convolver" *Optical Engineering* Vol. 23, pp. 20–25, 1984 and by A. P. Goutzoulis in "Systolic Time-Integrating Acoustooptic Binary Processor" *Applied Optics,* Vol. 23, pp. 4095–4099, 1984. The most often heard criticism of the DMAC algorithm, when used in matrix multiplication, is the complication arising from the need for high-speed electronic analog-to-digital converters for converting the mixed binary back to binary form.

In a recent advancement H. J. Caulfield has provided an "existence proof" for optical floating-point matrix algebra in his article entitled "Floating Point Optical Matrix Calculations" *Optical Engineering* Vol. 22, No. 6, pp. 765–766, November–December 1983 (he expounds on the feasibility of floating point optical matrix-vector multiplication calculations).

Thus there exists in the state-of-the-art a continuing need for an implementation of the DMAC algorithm to perform matrix-vector multiplications involving matrices and vectors whose elements are represented in binary floating-point form and an acousto-optical time-integrated architecture to implement the DMAC algorithm as well as a technique to eliminate the need for analog-to-digital converters at the optical processor back-end.

SUMMARY OF THE INVENTION

The present invention is directed to providing an apparatus and method for performing optical matrix-vector multiplication using floating-point arithmetic. A source beams collimated light through a first means disposed to be illuminated by the collimated light for providing an encoded representation of a first vector element in a serial bit stream, the first vector encoded representation providing means is adaptable to be incrementally displaced in a first direction past the collimated light source. A second means is disposed to be illuminated by the portion of collimated light passing through the first vector encoded representation providing means for providing an encoded representation of a matrix in parallel bit streams. The matrix encoded representation providing means is adapted to be incrementally displaced in a second direction that is opposite said first direction as it passes the collimated light source and the interposed first vector encoded representation providing means. The encoded representations of the first vector and matrix are normalized floating point representations and the passing of collimated light that traverses the encoded representations of the first vector encoded representation providing means through the encoded representations of the matrix encoded representation providing means effects a multiplication thereof. Means are disposed in an aligned relationship with the first vector encoded representation providing means and the matrix encoded representation providing means for adding multiplied encoded information. The incremental displacements of the first vector and matrix encoded representation providing means are synchronized and a means is coupled to the adding means for decoding the mixed binary representations to decimal signals. Transparent and opaque portions in the vector and matrix encoded representation providing means express the normalized floating point representations in binary form.

The prime object of the invention is to aid in the optical processing of data by application of the DMAC algorithm.

Another object is to provide for an apparatus by which the DMAC algorithm is implemented in a floating-point optical matrix-vector multiplication application.

Still another object of the invention is to implement the DMAC algorithm to perform floating-point optical matrix vector multiplication.

Still another object is to provide for an optical processing architecture eliminating analog-to-digital converters to provide a binary output.

Still another object is to provide for the use of the DMAC algorithm employing acousto-optical time-integrating architectures for implementing matrix-vector multipliers.

These and other objects of the invention will become more readily apparent from the ensuing specification when taken in conjunction with the drawings and the appended claims.

DESCRIPTION OF THE PREFERRED EMBODIMENT

The underlying theory to perform floating-point matrix-vector multiplication is an extension of the DMAC algorithm previously used only for fixed-point arithmetic. To simplify what might be otherwise complicated in a matrix multiply operation, an innerproduct operation is discussed as it concerns two vectors. These two vectors and their multiplication can best be understood from the following example. Two vectors a and b each contain two elements. An inner product of a and b, denoted by c, is given by $$c=a\cdot b=a_1b_1+a_2b_2.$$

For this example the elements of the vectors a and b are given the following normalized floating-point representations:

$$a_1=(0.101)2^{+2}$$

$$a_2=(0.110)2^{-2}$$

$$b_1=(0.111)2^{-1}$$

$$b_2=(0.101)2^{+1}.$$

The 3 bit mantissas associated with each of the vector elements are strictly positive. The exponents are bounded between $-2$ and $+2$.

Figure 1:
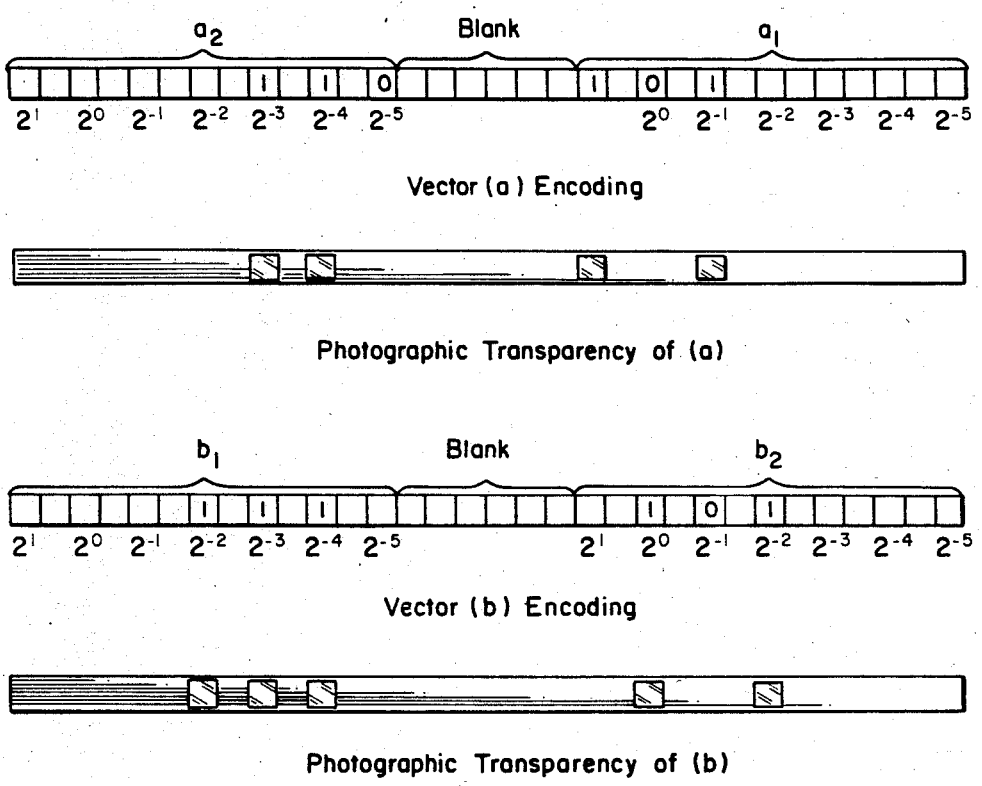
FIG. 1 depicts the optical encoding of vector information in binary form on photographic film.

Both the vector a and the vector b information are separately recorded as one-dimensional bit patterns on an optical recording medium, for example, a photographic film, as depicted in FIG. 1. For this particular example 13 pixels are allocated for each vector element with 6 blank pixels between adjacent elements to eliminate undesirable crossterms. Each mantissa is encoded directly onto the recording medium as it appears in normalized form. However, the exact position of the mantissa within the allowed 13-pixel window is dictated by the value of the corresponding exponent. Ones are encoded as transparent squares, whereas zeros and blanks are encoded as opaque squares.

The two one-dimensional transparencies of a and of b as depicted in FIG. 1 are allowed to slide past each other in front of a 13-element photodetector line array while being illuminated by a pulsed collimated light source. This arrangement is schematically shown in FIG. 2.

Figure 2:
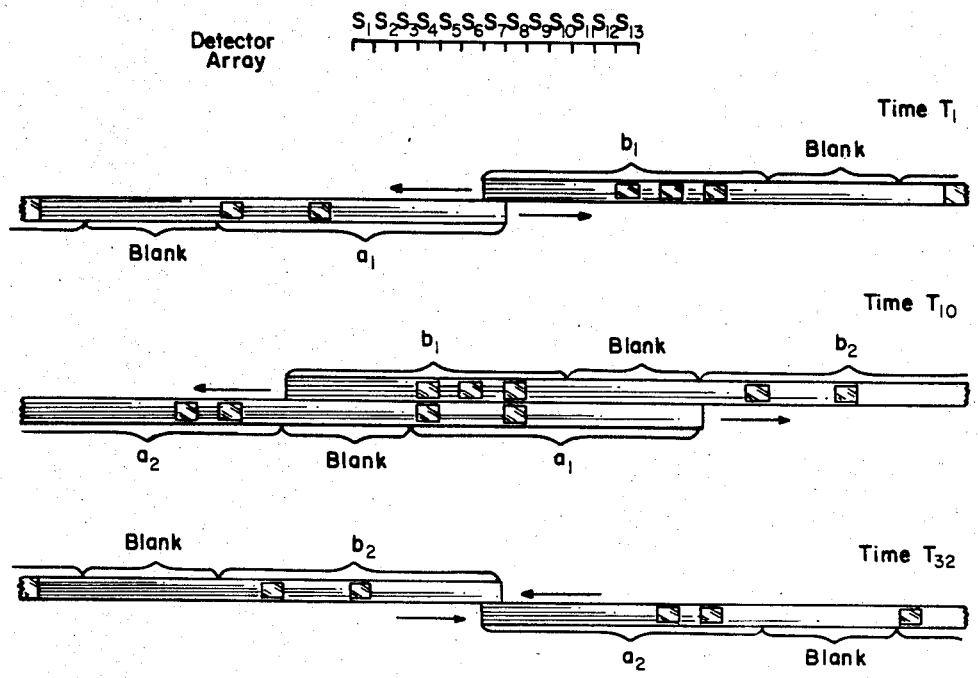
FIG. 2 sets forth in schematic form the initial, intermediate and final positions of counter-propagating binary data vectors set forth in FIG. 1.

FIG. 2 depicts the initial position at a time $T_1$, some intermediate position at a time $T_{10}$ and at a final position at a time $T_{32}$ of each of the two transparencies relative to the photodetector array during the sliding process. While the transparencies are sliding past each other, the light source is pulsed thirteen consecutive times, turned off for the equivalent of six pulse durations and again pulsed thirteen consecutive times. During this sequence, each detector element within the line-array accumulates electric charge proportional to the total light received at that detector element site. Only when transparent squares from each transparency overlap a detector element site, will light be detected at that site.

Figure 4:
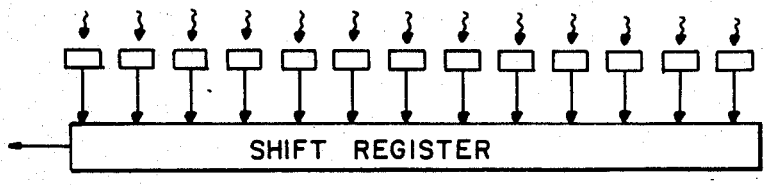
FIG. 4 shows a line of detectors arranged in an array coupled to a shift register for providing a mixed binary output signal.
Figure 3:
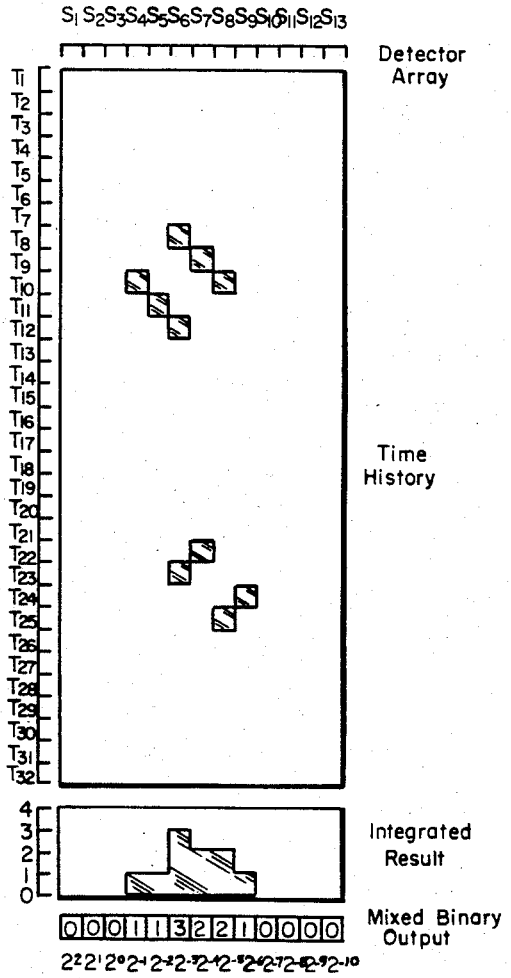
FIG. 3 shows a time history of the elastic charge accumulated on each detector element that can be expressed as an inner product mixed binary output.

A time history of the light received, as well as the total electric charge accumulated at each detector element is shown in FIG. 3. The total electric charge generated at each detector site contains partial information about the mixed binary representation of the desired inner product involving a and b. This mixed binary representation for a line array of detectors suitable for providing an output for an a and b inner product is shown in FIG. 4. The number of detectors are coupled to a shift register which shifts out the mixed binary product for further processing at the end of the arithmetic process herein described for the transparencies a and b.

The position of each detector element in the array corresponds to a particular power of 2. The charge accumulated at each detector element is proportional to the weighting coefficient associated with the corresponding power of 2. For this example the mixed binary inner product output is given by $$c=(1)2^{-1}+(1)2^{-2}+(3)2^{-3}+(2)2^{-4}+(2)2^{-5}+(1)\cdot 2^{-6}$$

which corresponds to the decimal number 1.328125.

Figure 5:
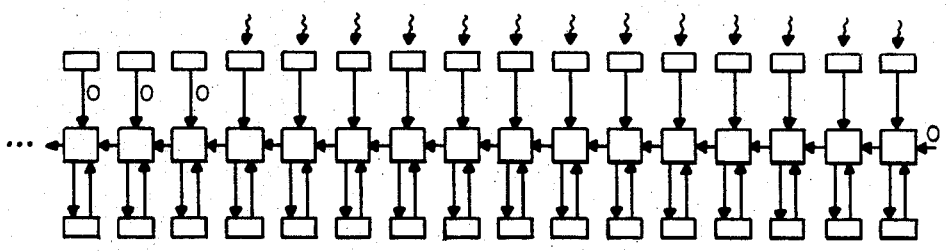
FIG. 5 is a schematic depiction along with a truth table for showing a line of a detector array coupled to full-adder elements and memory elements for providing a binary output.
Figure 5:
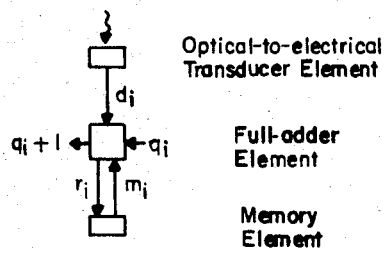

It is possible to avoid generating the mixed binary output by employing a one dimensional array of full-adders behind the photodetector array as depicted in FIG. 5. For this case, the electric charge generated at each photodetector site is clocked out in parallel at the end of each clock cycle $T_j$ into the full-adder array. Hence, the photodetector array merely acts as an optical-to-electrical transducer, that is, converting optical wavefronts of ones and zeros into electrical wavefronts of the same ones and zeros. Using a full-adder array, the output for this example would be given by $$c=(1)2^{0}+(0)2^{-1}+(1)2^{-2}+(0)2^{-3}+(1)2^{-4}+(0)2^{-5}+(1)2^{-6}.$$

Figure 6:
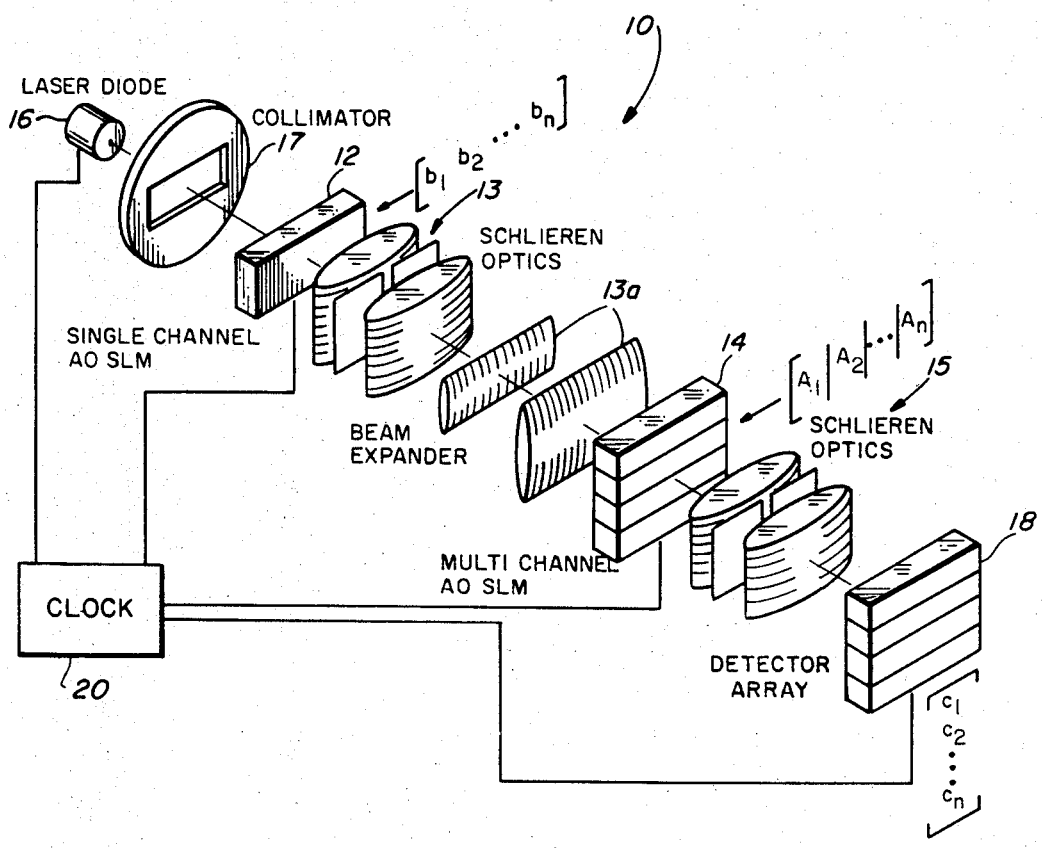
FIG. 6 is a schematic depiction of a time-integrating acousto-optical architecture employing the basic concepts to perform floating-point matrix-vector multiplication.

A further development of this idea and theory is extended to define an optical processing architecture utilizing dynamic, spatial light modulators in place of the photographic film to input the vector a and b information. Referring now to FIG. 6 a time integrating acousto-optical architecture 10 employs the aforedescribed basic concepts to perform floating-point matrix-vector multiplication. The input vector b information is encoded in the same format previously described. The resulting sequence of bits is loaded serially in time into a single-channel travelling wave acousto-optic modulator 12. Each row of an input matrix A is similarly encoded and loaded serially into a separate channel of a multi-channel travelling wave-acousto-optical modulator 14. Each row of the matrix can be said to correspond in form to the vector a data above; however, each row may have a different content. It is to be noted that all rows of the input matrix are loaded in a synchronous parallel manner.

The synchronization of the vector and matrix data flow and the pulsing of laser diode 16 is assured by a common clock 20 operatively connected to these elements as well as to a multi-channel detector array 18. This synchronization is essential to generate the desired output vector c information within a 2-dimensional photodetector array. Each element of the output vector c is generated by a different row of the detector array.

The typical example shown in FIG. 6 is potentially capable of performing a matrix-vector multiplication between a 200 by 200 matrix A and a 200 element vector b whose elements are represented in 32-bit floating point form (24-bit mantissa and 8-bit exponent) at 0.5 GFLOPS. This requires that laser diode 16, single channel acousto-optical modulator 12 and each channel of the multi-channel acousto-optical modulator 14 be clocked by clock 20 at approximately 2 GHz. The single-channel modulator, as well as each channel of the multi-channel modulator, must have a time-bandwidth product of approximately 560.

Typical components of the main constituents to demonstrate this inventive concept of the embodiment of FIG. 6 are selected from a variety of available items. It is to be emphasized that the components named below are for the purposes of demonstration only. One skilled in the art will make appropriate choices from equivalent items to meet the requirements of the job at hand. Laser 16 can be a 2-mW HeNe laser available from a number of commercially available sources that directs its output through a commercially available collimator 17 that is well known in the art. The collimator is selected to have the property of directing a collimated beam uniformly across the length of single-channel acousto-optical modulator 12. The single-channel acousto-optical modulator can be an Interaction ADM-70 Bragg cell modulator suitable electrically coupled to selectively defract the first order beam so that it appears to present transparent and opaque areas to transmitted first order light in much the same manner as the example of FIGS. 1–3 above.

Schlieren optics 13 are provided to intercept the first order beam passing through the single-channel acousto-optical modulator 12 and redirect it as a zero order beam to a pair of beam expander lenses 13*a* are provided to assure that the light beam covers entirely the active elements of multi-channel travelling wave acousto-optical modulator 14. Another Interaction ADM-70 Bragg cell modulator functions suitably to be suitably modulated to represent the information of input matrix a and another Schlieren optics 15 assures redirection of the transmitted first order beam from modulator 14 to detector array 18, a Reticon 512-element linear silicon photodiode array, for example.

The Bragg cells are electronically controlled in a manner well known in the art. Computers controlling appropriate driving circuitry could be employed. The detector array optionally is a CCD array also controlled in a well known manner.

A 2-channel, 16-bit word generator is used to digitally modulate a 70-MHz rf carrier (although gigahertz rates are anticipated) feeding the Bragg cells of single-channel acousto-optical modulator 12 and multi-channel acousto-optical modulator 14. The Bragg cells of the two modulators are aligned so that the first order diffracted beam from the first cell becomes the zero order beam for the second cell. Thus, when the digital data are fed in a counter propagating manner to the two cells, a convolution signal results. The linear diode array performs the addition of a number of multiples by integrating the convolved light signals from a series of digital words for a specified period of time and then clocking out the mixed binary result. A pulsed light source is not necessary for this scheme as there is light on the diode array only when digital data are present in both Bragg cells in single-channel travelling wave acousto-optical modulator 12 and multi-channel travelling wave acousto-optical 14.

Although the embodiment of FIG. 6 shows the constituents spread out it is to be understood that this is for demonstration purposes only of the inventive concept. A more realistic portrayal in an operative embodiment would call for condensing the support electronics for the Bragg cell modulators into a single compact unit and assembling the constituents as an integral unit to avoid ambient influences such as vibration, shock and temperature variations. In addition, the unit is interfaced to a microcomputer to allow the floating-point elements of two vectors to be entered and then fed to the DMAC processor for the inner product computation. The number of elements in each vector will, of course, depend upon the noise and dynamic range properties of the linear diode array. In like manner the microcomputer will allow the interfacing of the floating-point elements of a vector and a matrix such as that shown in FIG. 6, to be entered and fed to the DMAC processor for the inner product computation. The number of elements in both vector or vector and matrix will, of course, depend upon the noise and dynamic range properties of the linear diode array.

An oscilloscope's trace of the convolution between two 10-element vectors containing fixed-point 6-bit words with all ones in each digital word may have an essentially bell-shaped configuration. The resulting mixed binary output, showing the 10 multiply and adds performed, is obtained from the output scan of the diode array. A 40-MHz bandwidth capability of the Bragg cells used here requires that adjustments be made to the duty cycle of the bits in the modulating digital word thus limiting the number of bits which can be used for each word. With higher bandwidth modulators this limitation is relieved and 50–100 bit multiply-and-adds are possible.

Again it is pointed out the aforedescribed elements are for purposes of demonstration only. Data rates, the use of the information and the level of sophistication desired will make apparent to one skilled in the art the proper choice of commercially available elements without departing from the scope of this inventive concept.

Obviously many modifications and variations of the present invention are possible in the light of the above teachings. It is therefore to be understood that within the scope of the appended claims the invention may be practiced otherwise than as specifically described.

What is claimed is:

1. An apparatus for performing optical matrix-vector multiplication using floating-point arithmetic comprising:

a source of collimated light;

first means disposed to be illuminated by the collimated light for providing an encoded representation of a first vector element in a serial bit stream, the first vector encoded representation providing means is adapted to have the bit stream incrementally displaced in a first direction past the collimated light source;

second means disposed to be illuminated by the portion of collimated light passing through the first vector encoded representation providing means for providing an encoded representation of a matrix in parallel bit streams, the matrix encoded representation providing means is adapted to have the bit stream incrementally displaced in a second direction that is opposite said first direction as it passes the collimated light source and the interposed first vector encoded representation providing means, the encoded representations of the first vector and matrix are normalized floating-point representation, and the passing of collimated light that traverses the encoded representations of the first vector encoded representations of the matrix encoded representation providing means effects a multiplication and a convolving thereof; and means disposed in an aligned relationship with the first vector encoded representation providing means and the matrix encoded representation providing means for adding multiplied encoded information.

2. An apparatus according to claim 1 further including:

means coupled to the first vector encoded representation providing means and the matrix encoded representations providing means for synchronizing the simultaneous incremental displacements thereof.

3. An apparatus according to claim 2 in which the first vector encoded representation providing means and the matrix encoded representation providing means are Bragg cell, acousto-optical modulators and are encoded as to appear transparent and opaque signal transmission areas for the adding means.

4. An apparatus according to claim 3 in which the adding means provides mixed binary representation output signals and further includes:

means coupled to the adding means for decoding the mixed binary representations to decimal signals.

5. An apparatus according to claim 4 in which the collimated light source is pulsed each time bit streams of the first vector encoded representation providing means and the matrix encoded representation providing means are incrementally displaced.

6. An apparatus according to claim 5 further including;

means interposed between the first vector encoded representation providing means and the matrix encoded representation providing means for expanding the portion of collimated light passed through the first vector encoded representation providing means to assure it illuminates the matrix encoded representation providing means.

7. An apparatus according to claim 6 in which the collimated light which traverses the first vector encoded representation providing means is first order light and the light which traverses the matrix encoded representation providing means is first order light.

8. An apparatus according to claim 7 in which the adding means includes a CCD array.

9. An apparatus according to claim 8 further including:

first Schlieren optics to redirect a refracted first order beam to a relative zero order beam to the matrix encoded representation providing means; and second Schlieren optics to redirect a refracted first order beam to a relative zero order beam onto the adding means.

10. An apparatus according to claim 3 in which the adding means includes:

means coupled to the adding means for providing electrical binary signals from optical binary signals representative of the multiplied encoded information.

11. An apparatus according to claim 10 in which the adding means includes an array of photodetectors each having an adder adapted to have its charge clocked out in parallel after each incremental displacement of the first vector encoded representation providing means and the matrix encoded representation providing means.

12. An apparatus according to claim 11 in which the collimated light source is pulsed each time bit streams of the first vector encoded representation providing means and the matrix encoded representation providing means are incrementally displaced.

13. An apparatus according to claim 12 further including:

means interposed between the first vector encoded representation providing means and the matrix-encoded representation providing means for expanding the portion of collimated light passed through the first vector encoded representation providing means to assure it illuminates the matrix encoded representation providing means.

14. An apparatus according to claim 13 in which the collimated light which traverses the first vector encoded representation providing means is first order light and the light which traverses the matrix encoded representation providing means is first order light.

15. An apparatus according to claim 14 further including:

first Schlieren optics to redirect a refracted first order beam to a relative zero order beam to the matrix encoded representation providing means; and second Schlieren optics to redirect a refracted first order beam to a relative zero order beam onto the adding means.

* * * * *